United States Patent [19]

Sakaguchi et al.

[11] Patent Number: 5,028,844

[45] Date of Patent: Jul. 2, 1991

[54] DC DISCHARGE LAMP LIGHTING DEVICE

[75] Inventors: Yoshiyasu Sakaguchi, Kishiwada; Eiji Shiohama, Nara; Shoichi Morii, Hirakata, all of Japan

[73] Assignee: Matsushita Electric Works, Ltd., Japan

[21] Appl. No.: 477,472

[22] Filed: Feb. 9, 1990

[30] Foreign Application Priority Data

Feb. 23, 1989 [JP] Japan ..... 1-44453
Jun. 9, 1989 [JP] Japan ..... 1-147149

[51] Int. Cl.[5] ..... H05B 37/00
[52] U.S. Cl. ..... 315/160; 315/172; 315/226; 315/307
[58] Field of Search ..... 315/160, 161, 209 R, 315/226, 291, 307, 172

[56] References Cited

U.S. PATENT DOCUMENTS 4,649,322 3/1987 Tellan et al. ..... 315/160 X

FOREIGN PATENT DOCUMENTS 0226136 8/1985 Fed. Rep. of Germany ..... 315/160

*Primary Examiner*—Robert J. Pascal
*Attorney, Agent, or Firm*—Leydig, Voit & Mayer

[57] ABSTRACT

A DC discharge lamp lighting device includes a main discharge means providing a main discharge-lamp current to a DC discharge lamp including a filament and at least one anode to form between them a discharge path. The main discharge means comprises means for switching an applied voltage between a main discharge starting voltage in synchronism with a luminance control signal and a main discharge maintaining voltage. Any contribution of a current limiting resistance element to power consumption in circuit operation upon lighting of the discharge lamp can be reduced, thereby reducing heat generation.

4 Claims, 5 Drawing Sheets

DC DISCHARGE LAMP LIGHTING DEVICE

BACKGROUND OF THE INVENTION

1. Field of the Invention

This invention relates to a device for carrying out DC lighting of a DC discharge lamp.

A DC discharge lamp employing the DC discharge lamp lighting device of the kind referred to can be utilized effectively as a display element of a large scale image display apparatus employed at exposition grounds, athletic and baseball stadiums, and the like.

2. Description of the Related Art

Japanese Patent Publication No. 51-22311 discloses a device which is arranged to heat a filament of a DC discharge lamp with a filament current source, to apply between the filament and an auxiliary electrode a fine-discharging DC source through a current limiting resistance element having a high resistance value, and to apply between the filament and an auxiliary electrode a fine-discharging DC source through a current limiting resistance element having a high resistance value, and to apply between the filament and an anode (control electrode) a main-discharging DC source through a current limiting resistance element for supplying a main-discharging lamp current. In that device, therefore, a fine discharge is made to occur between the filament and the auxiliary electrode with the fine-discharging DC source, and normal lighting is carried out by applying a main discharge starting voltage higher than a fine discharge lamp voltage across the filament and the anode by means of the main-discharging DC source. In such a DC discharge lamp lighting device including current limiting resistance elements for fine and main discharging, a source voltage about twice as large as the main discharging lamp voltage has been required for the main-discharging DC source when the lighting characteristics of the DC discharge lamp, in particular the lamp voltage, luminance fluctuation, thermal characteristics of the lamp voltage, and the like are taken into account, so the heat generation in particular of the current limiting resistance element for the main discharging becomes extremely large. As a result, there have arisen the problems that a large scale image display apparatus including a large number of DC discharge lamps has to be provided with a large and expensive heat radiating means, that a thermal control for maintaining a proper temperature for excellent light emission efficiency has been made difficult due to the large heat generation, and the like.

Japanese Patent Application Laid-Open Publication No. 61-15194 discloses a discharge lamp lighting device in which an inductance element is employed as a current limiting element so as to reduce the heat generation. According to that device, a high frequency inverter is provided for converting a DC source voltage into a high frequency voltage, and the output of the high frequency voltage through a transformer of this high frequency inverter is applied through a choke coil and rectifying diode to a discharge lamp. Such conversion and application of the high frequency voltage generally require a complicated circuit arrangement, resulting in various problems such as increased manufacturing costs and the necessity of providing a measure against high frequency noise, which makes manufacture complicated. In order to light the DC discharge lamp stably even under a load fluctuation from a no load state to a full load state, it is necessary to keep the internal impedance of the high frequency inverter small. This causes the problem that the high frequency inverter must be a large size transformer so the entire lighting device becomes large and expensive.

U.S. Pat. No. 4,649,322 discloses a discharge lamp lighting device which allows a DC discharge lamp to be stably lit while reducing the heat radiation without increasing the size of the device. In that device, a filament in the DC discharge lamp is heated by a filament voltage source, a high voltage pulse is applied to the filament at predetermined intervals by a pulse generating means, and power is supplied from a DC power source to a control electrode of the discharge lamp for a power-supply maintenance time set by an instruction signal from an instruction signal generating means. According to that arrangement, stable lighting may be carried out by starting the lamp discharge with the high voltage pulses generated at the predetermined intervals, and luminous intensity regulation is realized by varying the power-supply maintenance time. However, the required provision of the high voltage pulse generating means as well as the DC power source including the instruction signal generating means is disadvantageous because it makes the related circuit arrangement complicated and makes the manufacturing costs high. In addition, the filament source voltage and high voltage pulses are applied constantly, so the consumption and the heat radiation cannot be adequately reduced.

SUMMARY OF THE INVENTION

A primary object of the present invention is to provide a discharge lamp lighting device which has a simple arrangement that can reduce manufacturing costs, which can minimize power consumption, heat radiation, and the size of the device, and which can effectively stabilize the lamp characteristics, particularly the startability of the lamp, the luminous intensity regulation upon variation in ambient temperature, and the amount of noise generation.

According to the present invention, this object can be realized by means of a discharge lamp lighting device which comprises a DC discharge lamp having a filament, at least one anode and a luminous discharge path formed between the filament and the anode, a main discharge means including a DC power source for providing to the discharge lamp through a current limiting resistance element a main discharge lamp current to obtain an effective luminance, and a fine discharge means rendering the DC discharge lamp to be in a fine discharge state so as to lower a main discharge starting voltage required for supplying the main discharge lamp current. The main discharge means includes means for controlling the luminance by rendering the amplitude of the main discharge lamp current substantially constant and controlling the pulse width with a luminance control signal. A voltage switching means is provided for the DC power source of the main discharge means for switching an applied voltage to the lamp between a main discharge starting voltage sufficiently higher than the fine discharge lamp voltage in synchronism with the luminance control signal and a main discharge maintaining voltage by the time the next luminance control signal is generated.

Other objects and advantages of the present invention should become clear from the following description of the invention with reference to embodiments shown in the accompanying drawings.

While the present invention will now be explained with reference to the embodiments shown in the accompanying drawings, it should be appreciated that the intention is not to limit the invention only to these embodiments but rather to include all modifications, alterations and equivalent arrangements possible within the scope of the appended claims.

DESCRIPTION OF THE PREFERRED EMBODIMENTS

Figure 1:
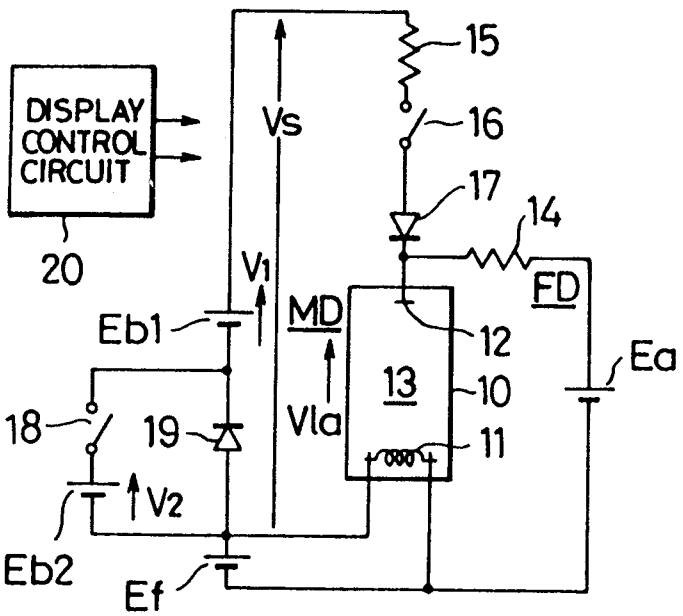
FIG. 1 is a circuit diagram of an embodiment of a discharge lamp lighting device according to the present invention.

Referring to FIG. 1, a DC discharge lamp 10 in a first embodiment of the discharge lamp lighting device according to the present invention includes a single filament 11 and one or more control electrodes, i.e., anode 12 (only one is shown in the embodiment of FIG. 1), and a luminous discharge path 13 is formed within the lamp between the filament 11 and the anode 12. Alternatively, a plurality of independent paths 13 can be formed between the filament and the respective anodes. Outside the lamp 10, a fine discharging DC source Ea is connected through a first current limiting resistance element 14 between the filament 11 and the anode 12, whereby a fine discharge circuit FD is formed for lowering the main discharge starting voltage required for supplying a main discharge lamp current to the DC discharge lamp 10 with the lamp in a fine discharge state. The voltage of a filament power source Ef is applied to the filament 11 of the DC discharge lamp 10 to provide a heating current to the filament 11. Between the filament 11 and the anode 12 of the DC discharge lamp 10, a main discharge circuit MD including first and second main discharging DC power sources Eb1 and Eb2 is connected. This main discharge circuit MD comprises means for carrying out luminance control by keeping the amplitude of a main discharge lamp voltage substantially constant and controlling the pulse width with a cyclic luminance control signal, and means for carrying out voltage switching so as to apply to the lamp the main discharge starting voltage, which is sufficiently higher than the fine discharge lamp voltage, in synchronism with the luminance control signal for a required time and thereafter to apply a main discharge maintaining voltage until the next luminance control signal is generated.

In the main discharge circuit MD according to the present embodiment, the luminance control means includes a series circuit of a second current limiting resistance element 15, a first switching element 16, and a diode 17. This series circuit is connected directly to the anode 12 of the lamp 10. In the voltage switching means, a second switching element 18 is connected in series with the second main discharging DC power source Eb2 to the first main discharging DC power source Eb1, and this series circuit is connected in parallel with a diode 19 which performs a bypassing function. This parallel circuit is inserted between the luminance control means and the filament 11 of the lamp 10. This voltage switching means provides as its output the sum V1+V2 of the voltage V1 of the first main discharging DC power source Eb1 and the voltage V2 of the second main discharging DC power source Eb2 when the second switching element 18 turns ON, but it provides only the voltage V1 as an output when the second switching element 18 turns OFF. The voltage V1 of the first main discharging DC power source Eb1 is the main discharge maintaining voltage which keeps the lamp continuously lit. In addition, the main discharge circuit MD is provided with a display control circuit 20 which controls the first and second switching elements 16 and 18 to light the DC discharge lamp on the basis of predetermined image signals when the device is employed as a large scale image display apparatus.

Figure 2:
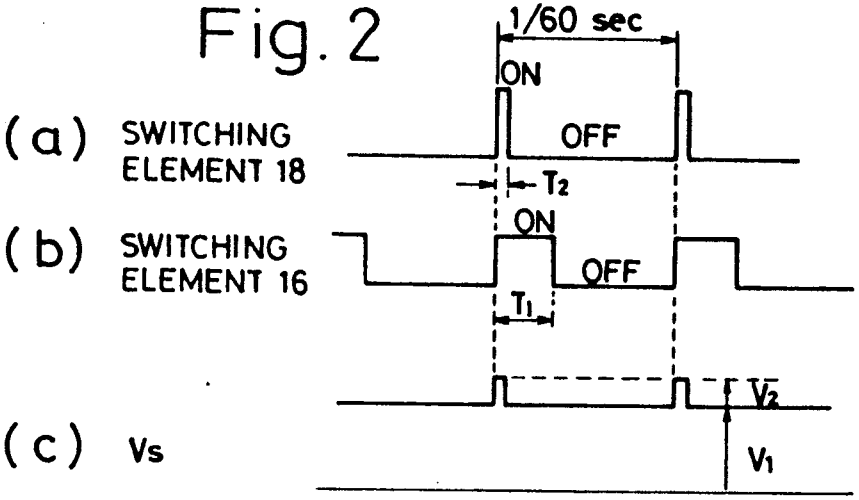
FIG. 2 is a time chart showing the relationship between a voltage switching means and a main discharge source voltage in the device of FIG. 1.
Figure 3:
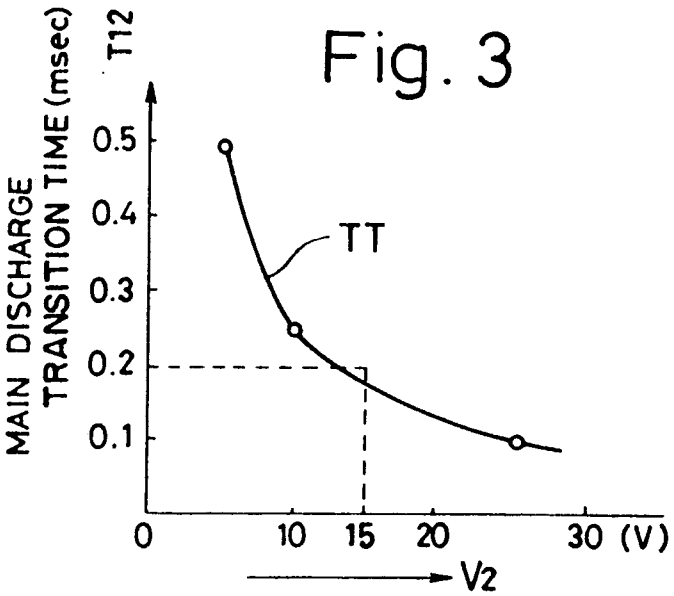
FIG. 3 shows graphically the relationship between the time required for a transition to main discharge and a second DC source voltage in the device of FIG. 1.

In the discharge lamp lighting device of the present embodiment, the main discharge maintaining voltage V1 shown in FIG. 2 is applied by means of the first main discharging DC power source Eb1 through the second current limiting resistance element 15, in addition to the fine discharge lamp current, when the first switching element 16 is turned ON for a time T1 as controlled by the display control circuit 20 at 60Hz, for example. Provided that the second switching element 18 is turned ON for a time T2 starting at the same point as the start of time T1, time T2 being, for example, 0.2 msec, the voltage V2 of the second discharging DC power source Eb2 is added to the voltage V1 and applied to the DC discharge lamp 10. That is, upon starting of the main discharge in one of the main discharge cycles, a high starting voltage such as Vs=V1+V2 is applied since the first and second switching elements 16 and 18 are both turned ON. As a result, the lamp can be reliably changed from the fine discharge state to the main discharge state even when the fine discharge lamp voltage is made relatively higher as, for example, the ambient temperature of the DC discharge lamp 10 decreases, or when the lamp voltage is elevated due to any fluctuation involved during the manufacture of the lamp 10. Here, the ON time T2 of the second switching element 18 is to be set with a condition (V2-T12), as shown in FIG. 3. As a result of tests, it was found that the relationship between the time T12 required for the transition to the main discharge state and the voltage V2 of the second main discharging DC power source Eb2 is as shown by curve TT in FIG. 3. From this curve, it can be seen that when the voltage V2 of source Eb2 is made 15 V, time T12 may be set to be 0.2 msec.

Figure 4:
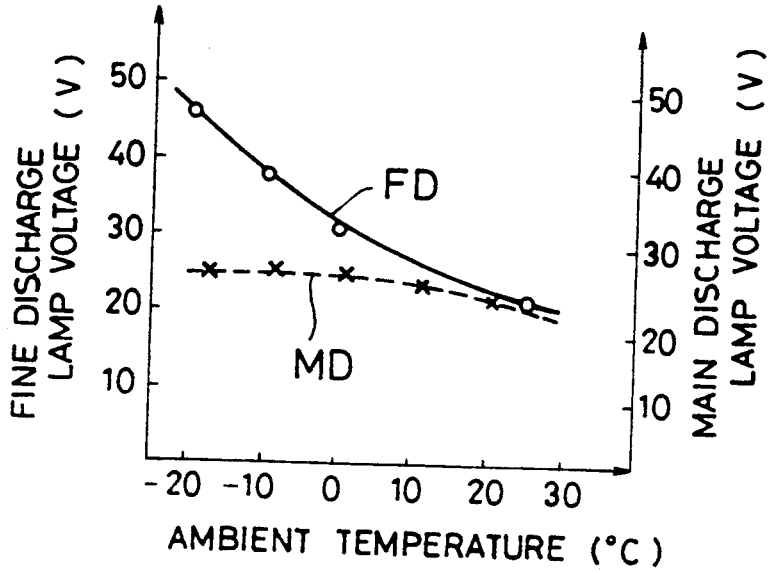
FIG. 4 shows graphically the relationship of ambient temperature to fine discharge lamp voltage and main discharge lamp voltage in a DC discharge lamp to which the device of FIG. 1 is applied.

FIG. 4 shows the results of further tests of the relationship between the ambient temperature of the DC discharge lamp 10 and the applied voltage. In FIG. 4, the fine discharge lamp voltage is shown by the solid line curve FD while the main discharge lamp voltage is shown by the dashed line curve MD. Assuming here that the main discharge lamp voltage V1a is 20 V at an ambient temperature of 25° C., the voltage applied to the DC discharge lamp 10 through the luminance control means including the current limiting resistance element 15 is Vs, and the lamp current is Ila, in a conventional discharge lamp lighting device, the voltage Vs was required to be 45 V in order to assure lighting down to an ambient temperature of −20° C. In this case, the required power consumption Wo for the current limiting resistance element in the conventional main discharge circuit was $$Wp = Ilax(Vs - Vla) = 25 \times Ila$$

so that the heat radiation from the second current limiting resistance element 15 in particular was extremely large. In contrast, the power consumption Wl in the current limiting resistance element 15 in the main discharge circuit MD in the present embodiment is $$\begin{aligned} Wl &= Ila(Vs - Vla) \times 0.2/16.7 + Ila(Vl - Vla) \times (16.7 - 0.2)/16.7 \\ &= 15.1 \times Ila \end{aligned}$$

even when V1 is set to be 35 V, taking into consideration a suitable division of voltage for stabilizing the lamp lighting. It will be appreciated that the power consumption Wl in the current limiting resistance element in the discharge lamp lighting device according to the present invention can be reduced to about ½ of the power consumption Wo in the same element in a conventional device. In the device of the present embodiment, the heat generation can therefore be reduced to a great extent so as to minimize the size of the heat radiation means and render a large and expensive heat radiation means unnecessary. It can also be seen that the circuit employing the current limiting element can be made inexpensive, thereby greatly reducing the general manufacturing costs since the circuit arrangement is simple and no high frequency inverter or complicated additional circuit is required.

While in the foregoing embodiment the timing of applying a high starting voltage such as V1+V2 for the main discharge starting voltage is set to be simultaneous with the turning ON of the first switching element 16, the arrangement may be modified to apply the starting voltage with a phase delay, in which event the response of the DC discharge lamp 10 in the transition from the fine discharging state to the main discharging state can be made excellent.

Figure 5:
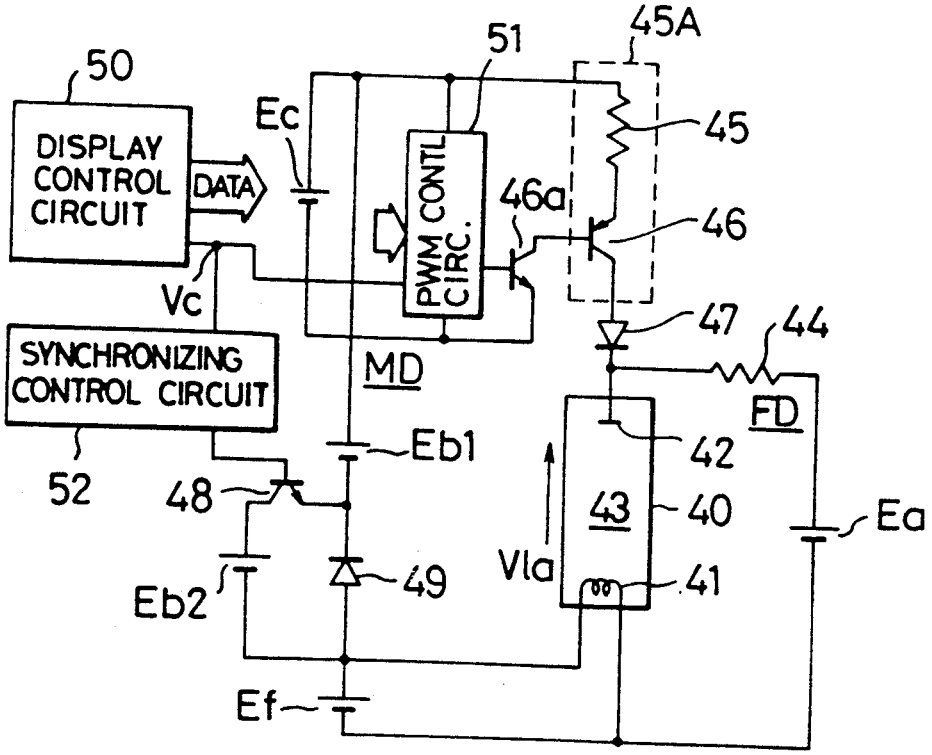
FIG. 5 is a circuit diagram showing the discharge lamp lighting device of FIG. 1 more concretely.

FIG. 5 shows the device of FIG. 1 more concretely. A PNP transistor 46 is employed as the first switching element and the second current limiting resistance element is formed by means of a constant current circuit 45A comprising the PNP transistor 46 and a resistor 45 having a current detecting function. In the luminance control means including the second current limiting resistance element, a driving power source Ec and an actuating transistor 46a are provided separately from the main discharge circuit MD, and a pulse-width modulation (hereinafter referred to as "PWM") control circuit 51 is connected parallel to the driving power source Ec. To this PWM control circuit 51, a control output from a display control circuit 50 is provided while biasing of the driving transistor 46a is performed by the PWM control circuit 51 so that the PNP transistor 46 is also turned ON and OFF following the ON and OFF operation of the transistor 46, and luminance control can thus be realized. The control output from the display control circuit 50 to the PWM control circuit 51 is also provided simultaneously to a synchronizing control circuit 52, and a transistor 48 that serves as the second switching element is also turned ON in synchronism with the transistor 46 that serves as the first switching element. Therefore, the high main discharge starting voltage V1+V2 is applied upon the start of the main discharge as described with reference to FIG. 2. As required, luminance data are provided from the display control circuit 50 to the PWM control circuit 51 for actuation of the circuit 51 on the basis of the luminance data. The structure and operation of the embodiment of FIG. 5 are otherwise the same as for the embodiment of FIG. 1, and the same elements as in FIG. 1 are denoted in FIG. 5 by the same reference numerals incremented by 30.

As the luminance data as well as a striking signal are provided from the display control circuit 50 to the DC discharge lamp 40 in the device of FIG. 5, they are converted into a luminance control signal by a PWM control signal in the PWM control circuit 51 to which the source voltage of the driving power source Ec is applied. The driving transistor 46a is turned ON by the luminance control signal, and the PNP transistor 46 is then turned ON, whereby the constant current circuit 46A comprising the PNP transistor 46 and current detecting resistor 45 is made to conduct, so the main discharge voltage is applied through the reverse current blocking diode 47 to the DC discharge lamp 40. On the other hand, a transistor 48 forming the second switching element is biased to be turned ON by a timing signal provided from the synchronizing control circuit 52 in synchronism with the start of ON operation of the PNP transistor 46 that serves as the first switching element. The synchronizing control circuit 52 has the function of a fixed timer and sets the time T2 referred to in FIG. 2, whereby the high main discharge starting voltage Vs=V1+V2 is applied during this period T2 to a series circuit of the constant current circuit 45A, diode 47, and DC discharge lamp 40. At this time, Vs is set to be sufficiently higher than the fine discharge lamp voltage, the discharging state of the lamp can be smoothly changed to the main discharging state, and the voltage V1 for the main discharge maintained by means of the first main discharging DC power source Eb1 is applied after the elapse of time T2. In the present embodiment, the main discharge lamp current can be maintained constant whether the voltage supplied from the main discharge circuit MD is V1+V2 or V1, the response of the DC discharge lamp 40 can be made excellent, and a high linearity can be obtained in the relationship between the pulse width and the luminance of the lamp.

According to another feature of the present invention, there is provided a discharge lamp lighting device which can be effectively employed indoors and at night. While the display in sunlight in outdoor use demands a high contrast display, indoor use or use in the evening or at night calls for decreased maximum luminance that is less than about ½ to ⅓ of that of the display in sunlight, and a decrease in the minimum luminance (black level) becomes important for attaining a good quality display. In the foregoing embodiment, it is possible to obtain an excellent display ability since the heat generation is reduced to one half of that of conventional devices and the linearity of the pulse width and the luminance can be maintained high even in a relatively low luminance zone. However, in the above arrangement where the fine discharge lamp voltage is constantly applied to the DC discharge lamp, i.e., when the lamp is constantly being lit finely or slightly, the minimum luminance is made relatively higher. If the maximum luminance is simply made lower, the contrast ratio is likely to worsen. According to another feature of the present invention, therefore, a discharge lamp lighting device is provided which can greatly lower the minimum luminance.

Figure 11:
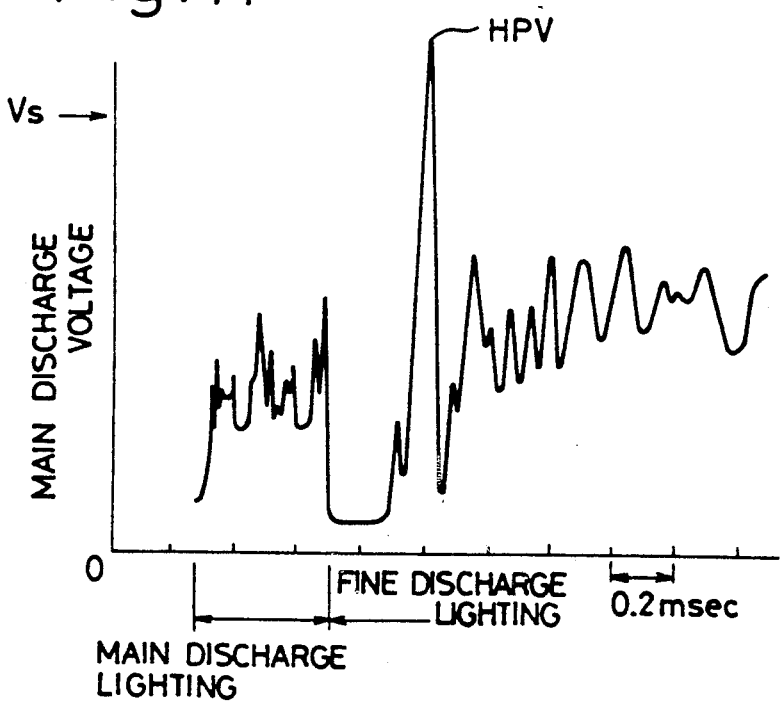
FIG. 11 is a graph of the relationship between the main discharge voltage and pulsating voltage in the discharge lamp lighting device.

When the fine discharge lamp voltage is always applied to the DC discharge lamp as shown in FIG. 11, it has been found that a high pulsating voltage HPV is generated in the initial stage of the fine discharge lighting after the main discharge lighting. This high pulsating voltage HPV is generated every time the pulse width of the lamp current for the DC discharge lamp is controlled, that is, every time the first switching element is turned ON. It is thought that this high pulsating voltage HPV is caused by an oscillation in discharging phenomenon at the anode of the DC discharge lamp. If the high pulsating voltage reaches a level higher than the fine discharging source voltage, the fine discharge lighting cannot be maintained, and not only the luminance control but also the fine discharge lighting are made ineffective. Accordingly, it becomes necessary to render the fine discharging source voltage higher than the high pulsating voltage HPV. However, if the fine discharging source voltage is made higher, a lowering of the minimum luminance can not be expected, as referred to above.

Figure 6:
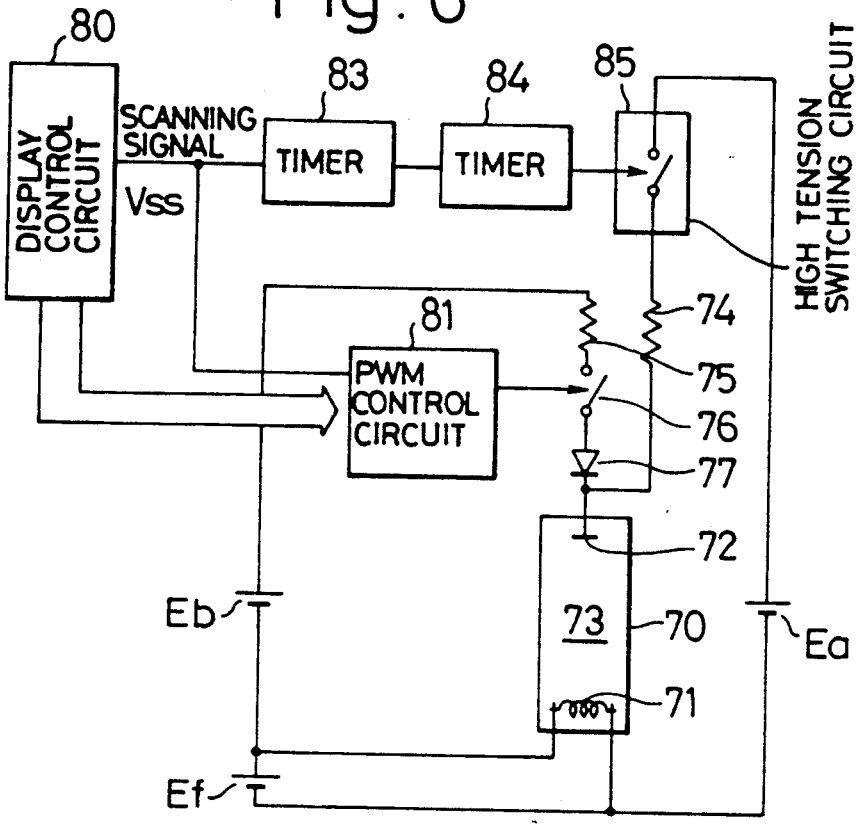
FIG. 6 is a circuit diagram of another embodiment of the discharge lamp lighting device according to the present invention.

According to the instant feature of the present invention, in contrast to the arrangements of FIGS. 1 and 5, a discharge lamp lighting device is provided which can greatly lower the minimum luminance. Referring to FIG. 6, the anode 72 of the DC discharge lamp 70 is connected to a luminance control means which comprises a series circuit of a current limiting resistance element 75, switching element 76, and diode 77. A voltage of a single main discharging DC power source Eb is connected to this series circuit. Switching element 76 is driven by the output of a PWM control circuit 81 connected to a display control circuit 80 which provides to the PWM control circuit 81, together with luminance data, a scanning signal Vss, which is also provided to timers 83 and 84 connected in two stages. Timers 83 and 84 are so actuated to delay the phase of the scanning signal Vss so that the first timer 83 produces a delay time T3 and the second timer 84 produces another delay time T4, as shown in the time chart of FIG. 7. The output of this series of timers 83 and 84 is provided to a high tension switching circuit 85 which is connected at one end to the fine discharging power source Ea and at the other end through a current limiting resistance element 74 to the anode 72 of the DC discharge lamp 70 so as to be turned ON and OFF with the given delay time T3 and T4. During the ON period, the voltage of the main discharging DC power source Eb is applied between the filament 71 and the anode 72 of the DC discharge lamp 70.

Figure 7:
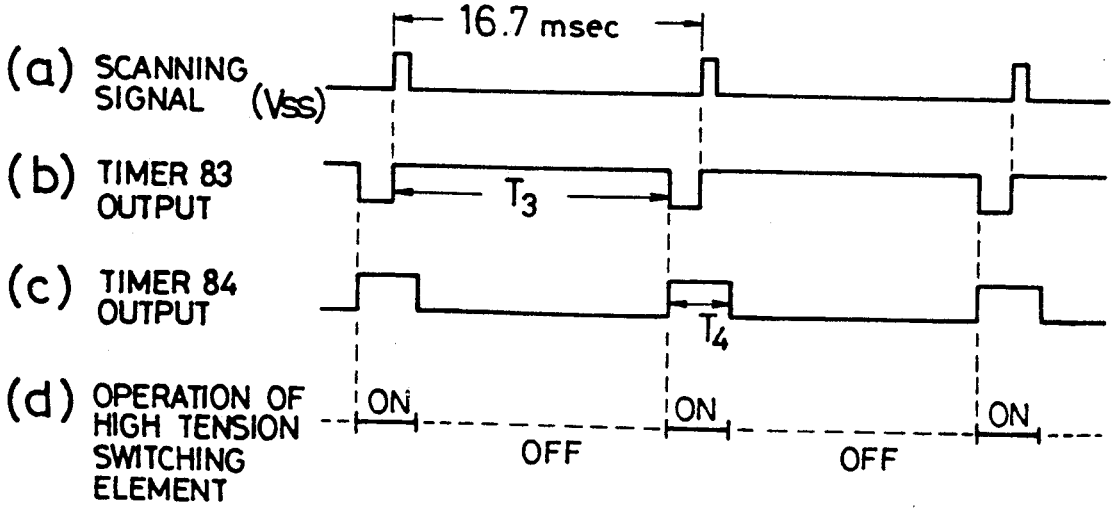
FIG. 7 is a time chart showing the operation of the device shown in FIG. 6.
Figure 8:
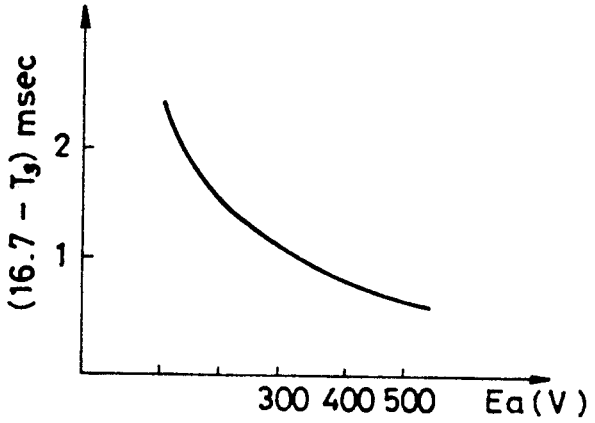
FIG. 8 is a graph of the relationship between a fine discharge source voltage and starting time of the DC discharge lamp.

As the scanning signal Vss shown by wave form (a) in FIG. 7 is provided by the display control circuit 80, delay time T3 shown by wave form (b) in FIG. 7 is generated by the first timer 83. Upon termination of delay time T3, delay time T4 shown by wave form (c) in FIG. 7 is generated by the second timer 84. As shown in (d) of FIG. 7, the high tension switching circuit 85 is turned ON only during the delay time T4 of the second timer 84 so that the fine discharge lamp current will pass through the current limiting resistance element 74 to the DC discharge lamp 70. More specifically, the delay time T3 of the first timer 83 is set on the basis of the cycle at which the next scanning signal Vss is received, the cycle being 16.7 msec in the case of 60Hz, so as to be 16.7 msec - T3 msec and long enough to carry out the light starting and the fine discharge. The setting of the delay time T3 may be performed on the basis of experimental data on the time required for the starting of the DC discharge lamp 70 with different values of the fine discharging power source Ea, as shown graphically in FIG. 8. For example, when the voltage of the fine discharging power source Ea is 500 V, the DC discharge lamp 70 is started when this voltage is applied to the lamp 70 for a period of 0.6–0.7 msec.

The scanning signal Vss is transmitted at predetermined time intervals, such as each time the large scale image display apparatus to which the lighting device of the present embodiment is applied is activated. A large number of the DC discharge lamps 70 forming the large scale image display apparatus are started one by one by the scanning signal Vss as a reference signal, and each lamp 70 is cyclically made to carry out fine discharge by the pulses provided from the second timer 84. These pulses have an optimal width T4 and phase as shown by wave form (c) of FIG. 7 with respect to the cycle of the scanning signal Vss at a frequency of 60Hz. Once the lamps carry out the fine discharge, the time width of the main discharge current is controlled upon application of the voltage of the main discharging power source Eb, which is considerably lower than the voltage level of the fine discharging power source Ea. With this arrangement, the high pulsating voltage which is higher than the voltage of the fine discharging power source can be prevented from being generated immediately after the turning OFF of the first switching element upon the application of the main discharge voltage, and a smooth fine discharge lighting can be assured. In this case, the fine discharge lighting may be for a slight period such as about 2–3 msec within the above-mentioned cycle of 16.7 msec in practice, so the luminance level at the black time of no main discharge current fed can be reduced to about 1/5, and the minimum luminance can be effectively lowered so that the contrast ratio can be greatly improved.

The structure and operation of the embodiment of FIG. 6 are otherwise substantially the same as for the embodiment of FIG. 1 or 5.

Figure 9:
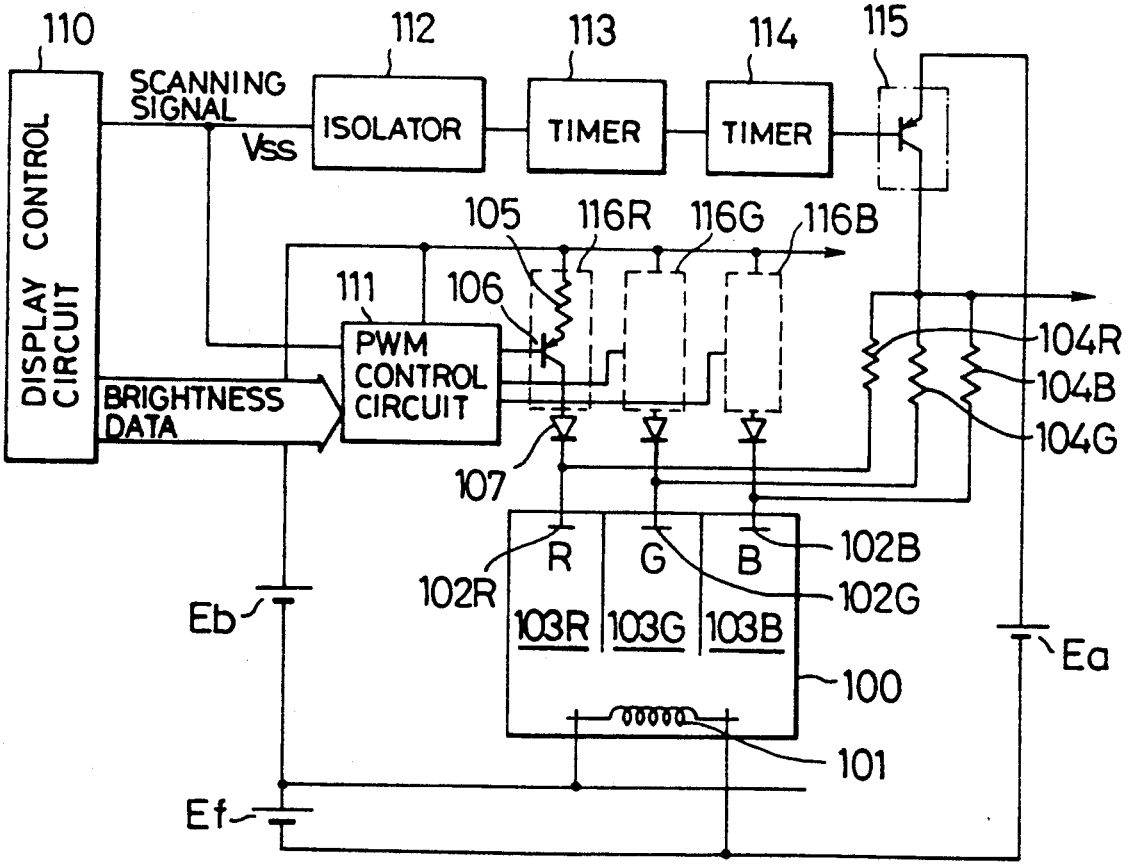
FIG. 9 is a circuit diagram of still another embodiment of the device according to the present invention.

FIG. 9 shows the device of FIG. 6 more concretely. The lamp 100 has a common filament 101. Three anodes 102R, 102G, and 102B, for example, are provided in the same lamp 100 in combination with three mutually independent luminous discharge paths 103R, 103G, and 103B formed for the three primary colors red, green, and blue. The luminous discharge paths 103R, 103G and 103B each have a duty ratio of 50%, and are lighted every 8.8 msec. The scanning signal Vss from the display control circuit 110 is provided, as isolated by an isolator 112, to a series of first and second timers 113 and 114 so as to drive a high tension switching circuit 115. In this case, a series circuit from the isolator 112 up to the high tension switching circuit 115 is provided common to the respective anodes 102R, 102G, and 102B for simplification of the circuit, and the voltage of the fine discharging power source Ea is applied through first current limiting resistance elements 104R, 104G, and 104B to the respective luminous discharge paths 103R, 103G, and 103B only when the high tension switching circuit 115 is on. The PWM control circuit 111 receiving the luminance data and scanning signal Vss from the display control circuit 110 is connected to luminance control means 116R, 116G, and 116B each comprising a series circuit of second current limiting resistance element 105 and switching element 106, so that luminance control outputs will be provided to each of the anodes 102R, 102G, and 102B.

Figure 10:
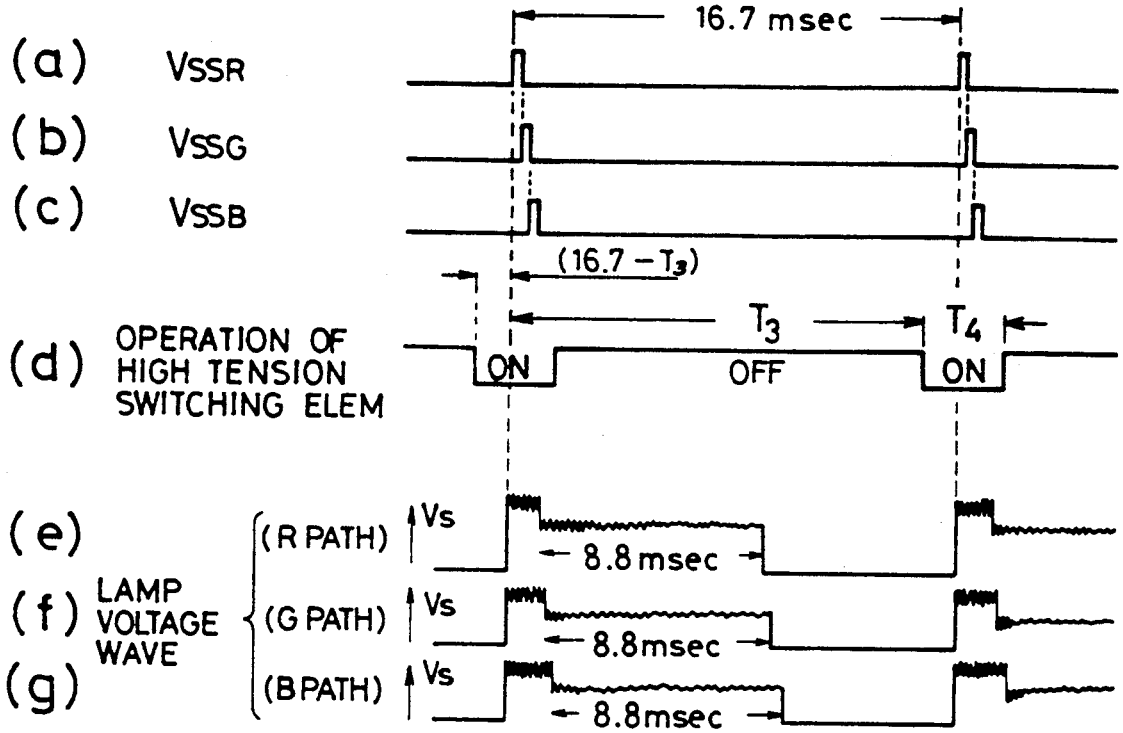
FIG. 10 is a time chart showing the operation of the device of FIG. 9.

As the device of FIG. 9 is started, the scanning signal Vss is generated at a frequency of, for example, 60Hz at the display control circuit 110, and this scanning signal Vss causes required scanning signals VssR, VssG, and VssB for the respective luminous discharge paths 103R, 103G, and 103B as shown by wave forms (a)-(c) in FIG. 10 to be prepared by means of flip-flop circuits or the like incorporated in the PWM control circuit 111 in accordance with predetermined sequence of operation, and to be provided from the circuit 111 to the respective luminance control means 116R, 116G, and 116B. In response to these signals, the switching element 106 in the respective luminance control means 116R, 116G and 116B is turned ON for a fixed time in synchronism with the luminance data with a duty ratio of 50% at intervals of 8.8 msec. On the other hand, the scanning signal Vss is also provided through the isolator 112 to the series of the first and second timers 113 and 114 in the same manner as in the embodiment of FIG. 6, so that the high tension switching circuit 115 is turned ON only for the time T4 as in wave form (d) of FIG. 10 and the voltage of the fine discharging power source Eb is applied simultaneously to the respective luminous discharge paths 103R, 103G, and 103B. After the time period of 16.7 msec - T3 msec from the start of the fine discharge control, the voltage of the main discharging power source Eb is first applied to the luminous discharge path 103R through the luminance control means 116R as a constant current circuit, and the voltage of the main discharging power source Eb is sequentially applied to the remaining luminous discharge paths 103G and 103B through each of the luminance control means 116G and 116B (see wave forms (e)-(g) in FIG. 10).

The structure and operation of the embodiment of FIG. 9 are otherwise substantially the same as for the embodiments of FIGS. 1, 5, and 6.

What is claimed is:

1. A DC discharge lamp lighting device comprising a DC discharge lamp having a filament, at least one anode and a luminous discharge path for said anode, a main discharge means including a DC power source for providing to said discharge lamp through a current limiting resistance element a main discharge lamp current to obtain an effective luminance, and a fine discharge means rendering said DC discharge lamp in a fine discharge state to lower a main discharge starting voltage required for supplying said main discharge lamp current, wherein said main discharge means includes means for controlling the luminance by rendering the amplitude of said main discharge lamp current substantially constant and controlling the pulse width of the main discharge lamp current with a cyclically-generated luminance control signal, and a voltage switching means for switching a voltage applied to said lamp by said DC power source between a main discharge starting voltage, which is higher than said fine discharge lamp voltage and is applied to said lamp in synchronism with said luminance control signal, and a main discharge maintaining voltage by the time the next luminance control signal is generated.

2. The device according to claim 1 wherein said DC discharge lamp has a plurality of anodes and a plurality of luminous discharge paths, each of which corresponds to one of said anodes and is provided a common voltage by said DC power source.

3. The device according to claim 1 wherein said current limiting resistance element is included in a constant current circuit.

4. The device according to claim 1 wherein said fine discharge means includes a fine discharge control means which turns the fine discharge means ON for a predetermined time long enough to start said DC discharge lamp prior to the start of luminance control by said means for controlling the luminance.

* * * * *